US009957632B2

(12) United States Patent
De Strycker et al.

(10) Patent No.: US 9,957,632 B2
(45) Date of Patent: May 1, 2018

(54) METHOD FOR PRODUCING A METAL COATING

(71) Applicant: ONDERZOEKSCENTRUM VOOR AANWENDING VAN STAAL N.V., Zelzate (BE)

(72) Inventors: Joost Remi Margueritte De Strycker, Zelzate (BE); Philippe Jose Gaston Hubert Verpoort, Zelzate (BE); Eva Diaz Gonzales, Zelzate (BE); Krista Godelieve Oscar Van Den Bergh, Zelzate (BE); Robbie Van De Coevering, Zelzate (BE)

(73) Assignee: ONDERZOEKSCENTRUM VOOR AANWENDING VAN STAAL N.V., Zelzate (BE)

( * ) Notice: Subject to any disclaimer, the term of this patent is extended or adjusted under 35 U.S.C. 154(b) by 565 days.

(21) Appl. No.: 14/406,146

(22) PCT Filed: Jun. 6, 2013

(86) PCT No.: PCT/EP2013/061663
§ 371 (c)(1),
(2) Date: Dec. 5, 2014

(87) PCT Pub. No.: WO2013/182631
PCT Pub. Date: Dec. 12, 2013

(65) Prior Publication Data

US 2015/0147586 A1 May 28, 2015

(30) Foreign Application Priority Data

Jun. 8, 2012 (EP) ..... 12171315

(51) Int. Cl.
*C25D 3/66* (2006.01)
*C25D 5/34* (2006.01)
(Continued)

(52) U.S. Cl.
CPC ..... *C25D 5/34* (2013.01); *C25D 3/665* (2013.01); *C25D 5/10* (2013.01); *C25D 5/14* (2013.01);
(Continued)

(58) Field of Classification Search
CPC ..... C25D 5/10; C25D 5/34; C25D 5/36
(Continued)

(56) References Cited

U.S. PATENT DOCUMENTS 2,873,233 A 2/1959 Schnable
3,294,498 A * 12/1966 Carter ..... C23C 26/00 428/593
(Continued)

FOREIGN PATENT DOCUMENTS

EP 1322591 A2 4/2002
WO 0226381 A2 4/2002

OTHER PUBLICATIONS

Liu et al., Electroplating of Mild Steel by Aluminium in a First Generation Ionic Liquid: A Green Alternative to Commercial Al-Plating in Organic Solvents, Surface & Coatings Technology (no month, 2006), vol. 201, pp. 1352-1356.*
(Continued)

*Primary Examiner* — Edna Wong
(74) *Attorney, Agent, or Firm* — Banner & Witcoff, Ltd.

(57) ABSTRACT

Methods for electrochemical deposition of a metal coating on a metal substrate are described. The method may use an ionic liquid as an electrolyte, and the substrate may comprise a first metallic element. Method steps may include pretreating the substrate by etching in an ionic liquid containing metal ions of a second metallic element, removing metal ions of the first metallic element from the substrate, wherein the metal ions of the first metallic element are received by the ionic liquid, depositing a transition layer on the substrate
(Continued)

from the ionic liquid, wherein metal ions of the first and second metallic elements are incorporated in the transition layer, and depositing a coating on the transition layer by electrochemical deposition from an ionic liquid containing ions of the second metallic element.

16 Claims, 5 Drawing Sheets

(51) Int. Cl.

| | |
|---|---|
| ***C25D 5/36*** | (2006.01) |
| ***C25F 3/02*** | (2006.01) |
| ***C25F 3/06*** | (2006.01) |
| ***C25D 5/10*** | (2006.01) |
| ***C25D 5/14*** | (2006.01) |

(52) U.S. Cl.
CPC ..... *C25D 5/36* (2013.01); *C25F 3/02* (2013.01); *C25F 3/06* (2013.01); *Y10T 428/12458* (2015.01)

(58) Field of Classification Search
USPC ..... 205/232, 230, 170, 176, 210, 211, 217, 205/219
See application file for complete search history.

(56) References Cited

U.S. PATENT DOCUMENTS

| | | | |
|---|---|---|---|
| 3,694,326 | A | 9/1972 | McCabe et al. |
| 5,413,646 | A | 5/1995 | Dash et al. |
| 2005/0067296 | A1 | 3/2005 | Linde et al. |
| 2011/0000793 | A1 | 1/2011 | Kruse et al. |

OTHER PUBLICATIONS

Eugenio et al., "Electrochemical Aspects of Black Chromium Electrodeposition from 1-Butyl-3-Methylimidazolium Tetrafluoroborate Ionic Liquid," Electrochimica Acta (no month, 2011), vol. 56, pp. 10347-10352.*

Abbott et al., "Electrodeposition of Chromium Black from Ionic Liquids," Trans Inst Met Fin (no month, 2004), vol. 82, Nos. 1-2, pp. 14-17.*

Yagi et al., "Alternating Pulsed Electrolysis for Iron-Chromium Alloy Coatings with Continuous Composition Gradient," Journal of The Electrochemical Society (no month, 2007), vol. 154, No. 6, pp. D304-D309.*

Uerdingen et al., "Corrosion Behavior of Ionic Liquids," Green Chem. (no month, 2005), vol. 7, pp. 321-325. (Year: 2005).*

Konys et al., "Development of Advanced Al Coating Processes for Future Application as Anti-Corrosion and T-Permeation Barriers," Fusion Engineering and Design (no month, 2010), vol. 85, pp. 2141-2145. (Year: 2010).*

Dec. 21, 2016—(EP)—Extended Search Report—App: 16197790.5.

Abbot A P et al: "Electrofinishing of metals using eutectic based ionic liquids", Transactions of the Institue of Metal Finishing, Maney Publishing, Birmingham, GB, vol. 86, No. 4, Jul. 1, 2008, pp. 196-204.

European Search Report dated Nov. 7, 2012, for EP 12171315.0.

International Search Report dated Jul. 2, 2013, for PCT/EP2013/061663.

International Preliminary Report on Patentability Chapter II, dated Oct. 6, 2010, for PCT/EP2013/061663.

* cited by examiner

METHOD FOR PRODUCING A METAL COATING

The present application is a U.S. National Phase filing of International Application No. PCT/EP2013/061663, filed on Jun. 6, 2013, designating the United States of America and claiming priority to European Patent Application No. 12171315.0, filed Jun. 8, 2012. The present application claims priority to and the benefit of all the above-identified applications, which are incorporated by reference herein.

FIELD OF THE INVENTION

The present invention is related to the electrodeposition of metals on a substrate, wherein an ionic liquid is used as the electrolyte.

STATE OF THE ART

Electrodeposition of metal layers from ionic liquids is known in the art. Document EP1322591 describes for example the deposition of chrome on steel from an electrolyte composition of CrCl3.6H2O-choline chloride (2:1). The adhesion of the Cr layer, as mentioned in document EP132259, can be unsatisfactory.

Pretreatment of a substrate before applying a metal coating by means of electrodeposition is known in the art. Pretreatment can for example be done by etching in an acid, e.g. a dilute sulphuric acid, or by electrochemical etching in an ionic liquid.

US2011/0000793 discloses the cleaning of the surface of the substrate by means of electrochemical etching prior to the deposition process. The cleaning is carried out to remove microscopic bumps, contamination and/or oxide layers from the surface of the substrate. According to US2011/0000793, the electrochemical etching can be carried out in the same ionic liquid that is used for coating. This pretreatment can be carried out in a separate bath or in the same bath as in which the deposition of the metal layer takes place. However, according to US2011/0000793, contamination of the bath in which the deposition takes place by substance's removed from the substrate must be avoided.

SUMMARY OF THE INVENTION

The invention is related to a method as disclosed in the appended claims, which provides electrodeposited layers from ionic liquids and to a metal substrate provided with a metal coating, produced by the method according to at least one of the claims.

The invention is in particular related to a method for electrochemical deposition of a metal coating on a metal substrate, using an ionic liquid as the electrolyte, comprising the steps of:

- Pre-treating the substrate surface by subjecting the substrate to etching in a bath (1) of a suitable etching liquid,
- Depositing said coating by electrochemical deposition in a bath of said ionic liquid.

The invention aims to provide a method for producing a metal coating.

When using the method according to the present disclosure, generally a good adhesion of the coating to the substrate is obtained. It is likely that the good adhesion of the coating to the substrate as acquired by the process according to the invention is due to the presence of the transition layer that is formed between the substrate and the metal coating.

This transition layer is a co-deposited layer. The transition layer comprises chemical elements originating from the substrate material (in particular the first metallic element) as well as elements of the coating material (in particular the second metallic element). The formation of the transition layer is believed to be due primarily to metal ions of the first metallic element of the substrate that are released into the ionic liquid in which the pretreatment by etching took place during this pretreatment by etching. In accordance with the invention, metal ions of the first metallic element remain in this ionic liquid, preferably in the vicinity of the substrate, after the step of pretreatment by etching. Then the deposition of the transition layer starts (e.g. by reversing the electrical current), with the metal ions of the first metallic element being incorporated in the transition layer, together with metal ions of the second element that originate from the ionic liquid.

So, contrary to what is taught by the prior art, in the method according to the invention the metal ions of the first metallic element that are removed from the substrate during the pretreatment by etching are not contaminating the ionic liquid in which the pretreatment by etching took place, but instead form a useful part of it when this ionic liquid is used for the deposition of a transition layer.

In known methods often measures are taken in order to move metal ions that are removed from the substrate during pretreatment away from the substrate before the electrodeposition of any layer starts. Such measures are for example: performing the electrodeposition of such a layer in a different bath of ionic liquid than the pretreatment, by rinsing the substrate after the pretreatment by etching, by generating a strong flow in the ionic liquid over the surface of the substrate after the pretreatment by etching and/or by creating turbulence in the ionic liquid after the pretreatment by etching. In the method according to the invention however, metal ions of the first metallic element that are removed from the substrate during pretreatment by etching remain in the ionic liquid that is used for the pretreatment by etching and for the subsequent deposition of the transition layer, preferably in the vicinity of the substrate, so that these metal ions of the first metallic element are incorporated into the transition layer that is deposited before the actual coating that is made of the coating material is deposited.

So, in the method according to the invention, a method step is present between the pretreatment in which metal ions of the first metallic element from the surface of the substrate are removed by etching and the electrodeposition of the actual coating, which coating is mainly composed of the coating material that comprises the second metallic element. This step is the deposition of the transition layer which contains both the first metallic element and the second metallic element.

Optionally, the second metallic element is a main component of the coating material, which means that the second metallic element makes up at least 40 wt % of the coating material.

In accordance with the invention, the pretreatment by etching and the deposition of the transition layer take place in the same ionic liquid, so, in the ionic liquid that receives the metal ions of the first metallic element that are removed from the substrate during the pretreatment by etching and from which these metal ions of the first metallic element are used in the deposition of the transition layer. It is advantageous if at least a number of these metal ions of the first element remain in the vicinity of the substrate after they have been removed from the substrate during the pretreatment by etching, because this makes that the transition layer (that contains at least both the first and the second metallic element) is formed in a reliable way and has a good quality.

Probably the easiest way of making sure that the metal ions of the first metallic element remain in the vicinity of the substrate, is to accommodate the ionic liquid in a bath and to carry out both the pretreatment by etching and the deposition of the transition layer in this bath of ionic liquid. The ionic liquid is preferably not removed from this bath between the pretreatment by etching and the deposition of the transition layer. Preferably, the substrate is kept in this bath of ionic liquid between the pretreatment by etching and the deposition of the transition layer. Alternatively, if the substrate is removed from the bath of ionic liquid between the pretreatment by etching and deposition of the transition layer, the substrate is preferably not rinsed between the pretreatment by etching and deposition of the transition layer.

Optionally, the substrate maintains the same position inside the bath of ionic liquid between the pretreatment by etching and the deposition of the transition layer.

Preferably, there is a small flow of ionic liquid over the surface of the substrate during the deposition of the transition layer and during the deposition of the coating. The flow rate of the ionic liquid over the surface of the substrate is chosen such that it is small enough to prevent rinsing the ions of the first metallic element from the surface of the substrate, thus ensuring that a sufficient amount of ions of the first metallic element remain present in the vicinity of the surface of the substrate for the incorporation into the transition layer. However, the flow rate is large enough to prevent an undesired level of heating of the substrate and large enough to make sure that a sufficient amount of ions of the second metallic element are provided to the surface of the substrate for being incorporated into the transition layer or the coating. This means that in general the flow rate will be selected from the lowest part of the range of the flow rates that are typically used in electrodeposition from ionic liquids, or even that values will be chosen that are below the lowest part of the range of the flow rates that are typically used in electrodeposition from ionic liquids. For example, the velocity of the flow relative to the surface of the substrate will be less than 1 m/sec.

The pretreatment by etching preferably takes place by means of electrochemical etching. Electrochemical etching includes both electroless etching and etching in which a voltage difference is present between the substrate and a counter electrode. Alternatively or in addition, the pretreatment by etching is carried out by chemical etching. In that case, for example the ionic liquid itself functions as a chemical etchant, or additives have been added to the ionic liquid which cause chemical etching.

Optionally, the substrate is degreased and/or cleaned before the pretreatment by etching.

After the deposition of the transition layer, the coating is deposited onto the transition layer by electrochemical deposition. The deposition of the coating takes place in a bath of ionic liquid, which ionic liquid contains metal ions of the second metallic element.

The deposition of the coating layer can take place in the same bath of ionic liquid as the pretreatment and the deposition of the transition layer, or in a different bath.

When the deposition of the coating takes place in a different bath of ionic liquid, preferably the same type of ionic liquid is used for the deposition of the coating as for the pretreatment by etching and the deposition of the transition layer. It is even conceivable that the ionic liquid that is used in the pretreatment by etching and the deposition of the transition layer is transferred to the bath in which the deposition of the coating takes place. This transfer is likely to introduce some flow and/or turbulence in the ionic liquid, making any ions other than those of the coating material become more evenly distributed in the ionic liquid, reducing their concentration close the substrate, and therewith minimizing the effect of such ions on the composition of the coating.

When the deposition of the coating takes place in the same bath as in which the pretreatment by etching and the deposition of the transition layer have taken place, the ionic liquid that has been used for the pretreatment by etching and the deposition of the transition layer can be removed from the bath and replaced with fresh ionic liquid before the deposition of the coating. The fresh ionic liquid can be of the same type as the ionic liquid used in the pretreatment by etching and the deposition of the transition layer or of a different type. However, in case a different type of ionic liquid is used, it is noted that both the ionic liquid that is used for pretreatment by etching and deposition of the transition layer and the ionic liquid that is used for depositing the coating contain metal ions of the second metallic element.

When the deposition of the coating takes place in the same bath as in which the pretreatment by etching and the deposition of the transition layer have taken place, the ionic liquid that has been used for the pretreatment by etching and the deposition of the transition layer can be used for the deposition of the coating as well. Optionally, the flow rate of the ionic liquid over the surface of the substrate is increased after the deposition of the transition layer, making that during the deposition of the coating any ions other than those of the coating material are more evenly distributed in the ionic liquid, which reduces their concentration close to the substrate. This minimizes the effect of such ions on the composition of the coating.

Experiments have shown that the method according to the invention is suitable for providing a steel substrate, with Fe being the first metallic element, with a coating with chrome and/or an alloy of chrome and/or chrome in combination with a further element (e.g. silica or graphite) for example in the form of particles as the coating material, wherein the coating material has chrome (Cr) as the second metallic element. Optionally, the coating is deposited from an ionic liquid containing ions of chrome(III). Optionally, the coating comprises at least 40 wt % of chrome (Cr).

Optionally, the ionic liquid from which the coating is deposited does not only contain metal ions of the second metallic element, but also one or more further elements. A further element can be for example present in the form of particles or in the form of ions. Examples of further elements are silica, e.g. amorphous silica, graphite or for example a third metallic element. Such a third metallic element optionally is a different element than the first metallic element. Optionally, one or more further element is incorporated into the coating. For example, the third metallic element is part of the composition of an alloy which is the coating material. Or, in another example, particles of the further element are incorporated in the coating (e.g. silica particles in a chrome coating or graphite particles in a chrome coating).

The effect of improved adhesion of the coating is most prominent when the transition layer has some thickness. For example, in the situation of the substrate being made of steel and the coating material being or comprising chrome or a chrome alloy or chrome with a further element, the thickness of the transition layer is preferably at least about 0.15 μm. Generally, preferably, the thickness of the transition layer is between about 0.15 μm and 5 μm, and more preferably, the thickness of the transition layer is about 0.3 μm to about 2.5 μm. Thicker transition layers are possible as well. Transition layers of such thicknesses have shown good results with respect to the adherence of the coating to the substrate.

By the method according to the invention a transition layer can be obtained which has a composition that changes, preferably gradually changes, over its thickness. In that case, close to the substrate, the percentage of the first metallic element in the composition of the transition layer can be rather high, while the percentage of the second metallic element in the composition of the transition layer is rather low. For example, close to the substrate the first element could be about 80% and the second element could be about 20% of the composition. On the outside of the transition layer, close to where the actual coating will be present after its deposition, it can be the other way around: the percentage of the first metallic element in the composition of the transition layer could be rather low, while the percentage of the second metallic element in the composition of the transition layer is rather high. For example, the first element could be about 20% and the second element could be about 80% of the composition. The ratio between the percentage of the first metallic element and the second metallic element preferably gradually changes over the thickness of the transition layer.

It has been found that in general when for the etching pretreatment electrochemical etching is used in which a voltage difference is present between the substrate and a counter electrode, at least two process parameters of the pretreatment have an influence on the thickness of the transition layer. These two parameters are the etch time and the current density that is applied during this kind of pretreatment by electrochemical etching. Besides those two, the deposition time for the transition layer and/or of the transition layer and the coating layer together can influence the results that are obtained in the method according to the invention. The etch time is the duration of the pretreatment by etching. The deposition time for the transition layer is the duration of the step of the electrochemical deposition of the transition layer. The deposition time for the transition layer and the coating layer together is the duration of the method steps of the electrochemical deposition of the transition layer and the electrochemical deposition of the coating together.

In general, it has been found that the thickness of the transition layer increases when the etch time increases. The longer the etch time, the more metal ions of the first metallic element will be released from the substrate, making more of those ions available for incorporation in the transition layer.

Experiments have shown that etch times of 5 to 240 seconds result in a transition layer that provides a good adherence for the coating.

In general, initially the thickness of the transition layer increases when the level of the current density that is applied during the pretreatment by electrochemical etching increases. However, after exceeding a certain value of the etch current density, the thickness of the transition layer seems to decrease again.

In general, the thickness of the transition layer also increases with the deposition time, although in practice there will be a maximum, for example depending on the amount of metal ions of the first metallic element that are available for incorporation into the transition layer.

In general, the combined thickness of the transition layer and the coating increases when the deposition time for the transition layer and the coating layer together increases. The thickness of the coating can be increased by increasing the deposition time for the coating.

Process parameters of the pretreatment by etching and the deposition of the transition layer may influence the quality of the coating that is obtained. Process parameters of the pretreatment by etching and the deposition of the transition layer can for example have an influence on the amount of pitting (in size and in the number of pits in the coating surface) of the coating.

Experiments have indicated that there seems to be an optimum for the process parameters of the pretreatment by electrochemical etching of the type where a voltage difference is present between the substrate and a counter electrode and the deposition of the transition layer, in particular for the process parameters etch time and etch current density. The etch time and current density should be high enough to make sure that enough metal ions of the first metallic element are released from the surface of the substrate into the ionic liquid to obtain a transition layer with sufficient thickness, and to make sure that any metal oxide skin on the surface of the substrate is removed to a sufficient extent (too much metal oxide remaining on the surface of the substrate, over the entire surface or locally, may prevent good adhesion of the coating). On the other hand, the etch time and etch current density should not be so high that pitting of the coating occurs beyond an acceptable level, e.g due to locally increased etching of the surface of the substrate.

For example, it has been observed that where etch times of 5 to 240 seconds generally result in a good adherence for the coating layer, pitting of the surface of the coating already starts to occur when etch times of 60 seconds or more are used in the pretreatment of the substrate by electrochemical etching. At an etch time of 60 seconds up to at least 90 seconds, the pitting was however still at an acceptable level.

The etch time and the current density during the pretreatment by electrochemical etching of the type where a voltage difference is present between the substrate and a counter electrode together influence the intensity of the etching. The longer the etch time, the more intense the etching process. Also, the higher the current density during the pretreatment by electrochemical etching, the more intense the etching process. Experiments have shown that pitting of the coating may occur when the pretreatment by electrochemical etching has been too intense. So, in order to prevent pitting of the coating, either the etch time or the current density during the pretreatment by etching needs to be limited.

The table below indicates a relation between the etch time and a suitable range for the current density in an embodiment of the invention as was found during experiments:

| Etch time | Current density range |
|---|---|
| 5 to 20 seconds | 7 to 40 A/dm2 |
| 40 seconds | 7 to 30 A/dm2 |
| 45 seconds | 5 to 27 A/dm2 |
| 60 seconds | 5 to 22 A/dm2 |
| 75 seconds | 5 to 15 A/dm2 |

In a possible embodiment of the invention, the etch current density of the pretreatment by electrochemical etching is between 5 $A/dm^2$ and 22 $A/dm^2$, the etch time of the pretreatment by electrochemical etching is between 20 seconds and 80 seconds, preferably between 40-60 seconds. In an experiment, this embodiment was carried out with a deposition time for or the electrochemical deposition of the transition layer and the coating together of between 8 and 12 minutes, optionally 10 minutes. This deposition time however depends on the thickness of the coating that is desired.

According to the invention, the pretreatment step is preferably an electrochemical etching and the etching liquid is an ionic liquid.

In an embodiment of the invention, the ionic liquid that is used for the pretreatment by etching may be of the same type as the ionic liquid used for the deposition of the coating. In the latter case, said pretreatment by etching and the deposition of the coating may be performed in the same bath of said ionic liquid with the substrate not being removed from said bath between the pretreatment by etching and the deposition of the coating. The pretreatment by etching and the deposition of the transition layer take place in the same ionic liquid.

According to another embodiment, the pretreatment by etching is performed in another bath of ionic liquid than the deposition of the coating.

In an embodiment of the invention, the etch current density applied during the pretreatment by electrochemical etching is between 5 $A/dm^2$ and 150 $A/dm^2$ and the etch time is between 5 seconds and 500 seconds in case the electrochemical etching is of the type where a voltage difference is present between the substrate and a counter electrode.

According to a more specific embodiment, the etch current density is between 5 $A/dm^2$ and 100 $A/dm^2$ and/or the etch time is between 5 seconds and 400 seconds. According to a further embodiment, the etch current density is between 5 $A/dm^2$ and 50 $A/dm^2$ and/or the etch time is between 5 seconds and 250 seconds. According to a further embodiment, the etch current density is between 5 $A/dm^2$ and 40 $A/dm^2$, optionally between 5 $A/dm^2$ and 35 $A/dm^2$.

According to an embodiment, at least in a portion of the range for the etch time, the etch current density is between 5 $A/dm^2$ and a value that is decreasing, optionally linearly decreasing, as a function of increasing etch times.

According to an embodiment, the substrate is not rinsed in between the etching step and the deposition step.

According to an embodiment of the invention, the metal coating applied in the method of the invention may be a chrome coating or a chrome alloy coating or a coating comprising chrome and at least one further element. In particular, the coating material may be deposited from an ionic liquid containing ions of chrome(III). In this embodiment, the said ionic liquid that is used is a mixture consisting of or comprising choline chloride and CrCl3.6H2O, which ionic liquid may be used for etching and for deposition of the coating. Optionally, such an ionic liquid contains further additives.

Alternatively, an ionic liquid as described in WO2007/093574 or in WO2009/016189 may be used in embodiments of the invention, for example an ionic liquid in the form of a mixture of choline chloride and choline saccharinate.

In the method of the invention, the substrate onto which a coating is applied may be a, steel substrate.

The invention is equally related to a metal substrate provided with a metal coating, produced by the method according to the invention, the substrate comprising a first metallic element being the main component of said substrate, and the coating comprising a second metallic element, said second metallic element preferably being the main component of the coating, wherein a transition layer is present between the substrate and the coating, said transition layer having a thickness, and wherein the concentration of the first metallic element changes from a high value to a low value, preferably according to a gradually decreasing profile, from the substrate towards the coating, and wherein the concentration of the second metallic element changes from a high value to a low value, preferably according to a gradually decreasing profile, from the coating towards the substrate.

DETAILED DESCRIPTION OF THE INVENTION

Figure 1:
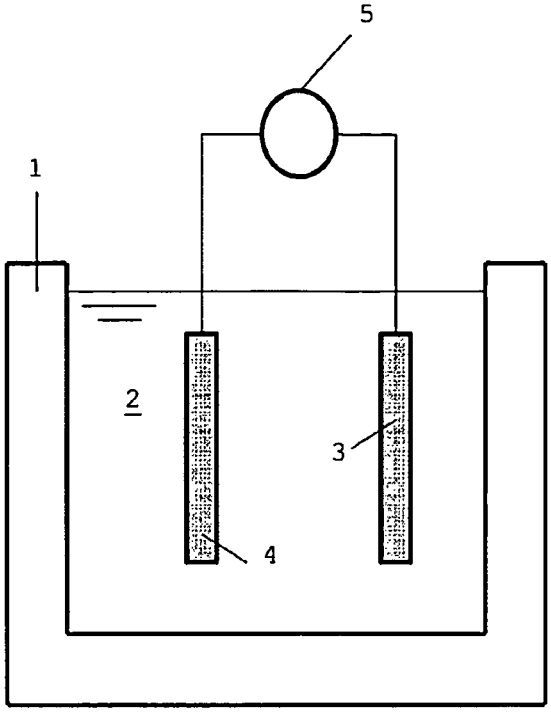
FIG. 1 is a schematic representation of the tools required in the method of the invention.

According to the invention, an etching step is performed as a pretreatment on a metal substrate to be coated, before the deposition of a metal coating on said substrate. At least the deposition step is executed by submerging the substrate in a bath of an ionic liquid, said ionic liquid being the source or at least one of the sources of the metal that forms the coating. The etching step is performed by submerging the substrate in a liquid, to thereby dissolve a portion of at least one metallic element contained in the substrate. The liquid may be a chemical etchant or it may be an electrolytic liquid, in which case the etching is an electrochemical etching. Said electrochemical etching may be an electroless etching, wherein the etching takes place without applying an external voltage to the substrate. According to a different embodiment, the electrochemical etching takes place by applying a voltage difference between the substrate and a counter-electrode, being submerged together with the substrate in a bath of the electrolyte.

The electrochemical deposition by submerging the substrate in an ionic liquid may take place by electroless deposition, wherein no external voltage is applied to the substrate.

Alternatively, the substrate is submerged together with a counterelectrode in said ionic liquid and an external voltage is applied between the substrate and the counter-electrode, resulting in the electrodeposition of a metal coating, the main constituent element and/or an other element of said coating originating from the metal ions present in the ionic liquid (or possibly, alternatively or in addition to the ionic liquid, from a soluble counter-electrode).

According to a preferred embodiment, the pretreatment by etching and deposition of the transition layer on the one hand, and deposition of the coating on the other hand take place in the same type of ionic liquid. This means for example one of the following options:

pretreatment by etching and deposition of the transition layer as well as deposition of the coating are performed in the same bath of ionic liquid, without removing the substrate from the bath in between etching and deposition of the transition layer and also not between the deposition of the transition layer and the deposition of the coating, pretreatment by etching and deposition of the transition layer are performed in a different bath of an ionic liquid than the deposition of the coating, the ionic liquid in the first and second bath being the same, pretreatment by etching and deposition of the transition layer are performed in a different bath of an ionic liquid than the deposition of the coating, the major components (i.e. components present above impurity level) of the ionic liquid in the first and second bath being the same, but the concentration of said major components being different, For example, the ionic liquid may consist of or comprise a mixture of choline chloride and CrCl3.6H2O, or an ionic liquid as disclosed in WO 2007/093574 or WO2009/016189, and the substrate may be a steel sheet or strip, or any other substrate, such as a steel roll. The aim is then to form a chrome coating on the steel substrate, by electrodeposition (electroless or not) from a bath of said mixture. In the present description, the term 'chrome coating' is to be understood as a coating comprising Cr, optionally as a main component, including pure Cr coatings as well as Cr-alloy coatings and coatings comprising Cr in combination with a further element, e.g. comprising Cr and silica and/or Cr and graphite.

FIG. 1 shows a schematic view of the required elements for performing an electrochemical etching and deposition according to the invention. A bath 1 filled with the ionic liquid 2 is provided. The substrate 3 to be coated is inserted in the liquid bath, and a counterelectrode 4 is equally inserted in the bath. In the case of a Cr-deposition on steel, the counterelectrode may be a chrome or chrome alloy electrode or an inert anode, such as a so-called Dimensionally Stable Anode (DSA) as known in the art or a combination of both. A power source 5 is connected to the substrate and to the counterelectrode, and is configured to be able to apply a positive or negative voltage difference between the two. For depositing the coating on a metal substrate, the substrate is connected to the negative terminal of the power source and the counter electrode is connected to the positive terminal. For etching the steel, i.e. removing Fe and/or oxides from the surface of the steel substrate, the connections are reversed. The electrochemical reactions that are at the basis of these phenomena are known to any person skilled in the art, and will not be described in detail here. Both the etching and deposition steps are preferably taking place in the same type of ionic liquid, optionally in the same bath, and preferably without removing the substrate from the bath in between the method steps. When the substrate is removed in between the steps, it is preferably not rinsed between said steps. It was found that with the method according to the invention, it is possible to obtain a good adhesion of the coating.

Current density and etch time are relevant parameters in the pretreatment by electrochemical etching of the type in which a voltage difference is present between the substrate and the counter electrode. The etch current density is preferably between 5 and 150 A/dm$^2$. According to another embodiment, the current density is between 5 and 100 A/dm$^2$. According to further embodiments, the current density is between 5 and 50 A/dm$^2$, between 5 and 40 A/dm$^2$, optionally between 5 and 35 A/dm$^2$. The etch time is preferably between 5 seconds and 500 seconds, or according to further embodiments: between 5 seconds and 400 seconds or between 5 seconds and 250 seconds.

By the method of the invention, generally metal coatings with good adhesion are obtained, as can be demonstrated by tests wherein the coating remains adherent to the substrate or not when a strip-shaped substrate is subjected to a bending test (described in more detail further in this description). It is clear to the skilled person that the above-described ranges for the current density may also be expressed in an equivalent way as ranges for the voltage difference between the substrate and the counter-electrode. It is also clear that the preferred conditions in terms of the current density can be applied by a potentiostatic setup (constant voltage difference) as well as by a galvanostatic setup (constant current). In the first case, a constant potential is maintained so that the current density may change during the etching or deposition. It can be easily verified however whether or not the current density, while not remaining constant, does remain within the boundaries given above.

Figure 2:
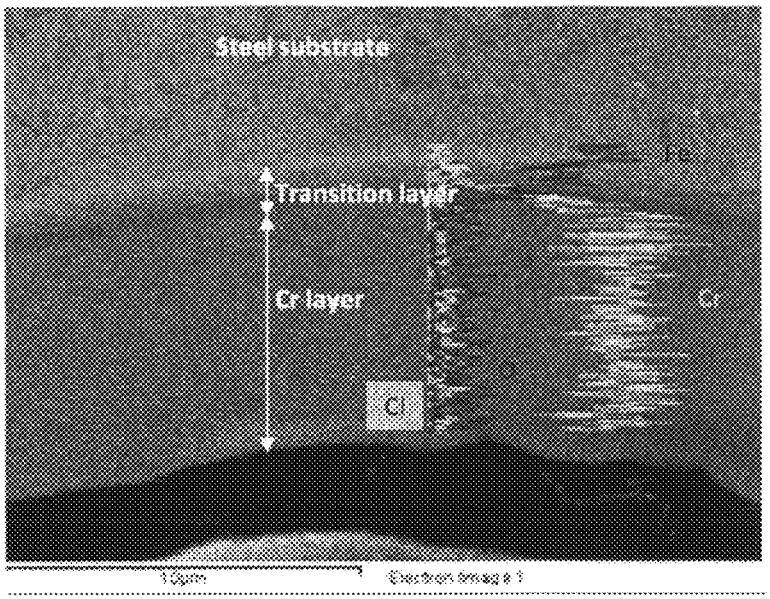
FIG. 2 is a SEM (Scanning Electron Microscope) picture showing the combination of the formed transition layer, together with the EDX (Energy-dispersive X-ray spectroscopy) profile, showing the quantitative analysis of several elements (like Fe, Cr, O, etc.), in the method of the invention applied for depositing a chrome coating.

It is likely that the improved adhesion is due to the presence of a transition layer, which is a co-deposited layer that is formed between the substrate and the metal coating. The transition layer comprises chemical elements originating from the substrate material (the first metallic element) as well as elements of the coating material (the second metallic element), as can be seen on the SEM picture in FIG. 2 in the case of Cr-coating deposited on a steel substrate: the Fe signal is slowly decreasing from the substrate into the Cr layer, while the Cr signal is increasing. In FIG. 2, the Cr layer is the coating that is deposited after the deposition of the transition layer. As tested by the inventors in the case of Cr-deposition on a steel substrate electrodeposited from a mixture comprising choline chloride and CrCl3.6H2O: when the substrate is taken out of the bath and thoroughly rinsed after the pretreatment and before performing the deposition in another ionic liquid bath, no transition layer is formed. When the substrate is not rinsed after etching and the deposition is again performed in another liquid, a transition layer does form. The formation of the transition layer is believed to be due primarily to the metal ions of the substrate remaining in the ionic liquid in which the pretreatment by etching took place, in particular in the vicinity of the substrate after the pretreatment by etching. It is therefore preferable not to rinse the substrate in between the etching and deposition steps, when the substrate is taken out of the etching bath and re-introduced into the same or another bath for the deposition step.

It was found that the thickness of the transition layer depends on the etch time and on the etch current density of the pretreatment by electrochemical etching. As a function of the etch current density and for a fixed etch time, the thickness of the transition layer reaches a maximum value above which the quality of the metal coating may deteriorate through the formation of pits in the surface. Therefore, within the larger boundaries for the etch time and the current density as defined above, there may be preferred ranges for these parameters that ensure good adhesion as well as good coating surface quality.

The above findings are hereafter illustrated for the case of a chrome coating deposited on a steel substrate from a mixture comprising choline chloride and CrCl3.6H2O (at a molar ratio of 2:1). The deposition time of the transition layer and coating together was 10 minutes or 5 minutes. The temperature during the pretreatment was 40° C. (in general said temperature is preferably between 30 and 60° C.). The counter-electrode was a chrome electrode. In a first experiment, the etch time was varied, for a number of fixed values of the current density during etching. In between the etching and the deposition step, the substrate remained in the ionic liquid bath. The adhesion of the resulting layer was tested by bending a coated sample up to 180°, according to the known 0T bending test (according to Standard NBN EN 13523-7). After bending, the surface on the top of the bend was inspected in order to see if the coating was still present and well-adhering. Also the surface appearance of the coating was assessed.

Figure 3:
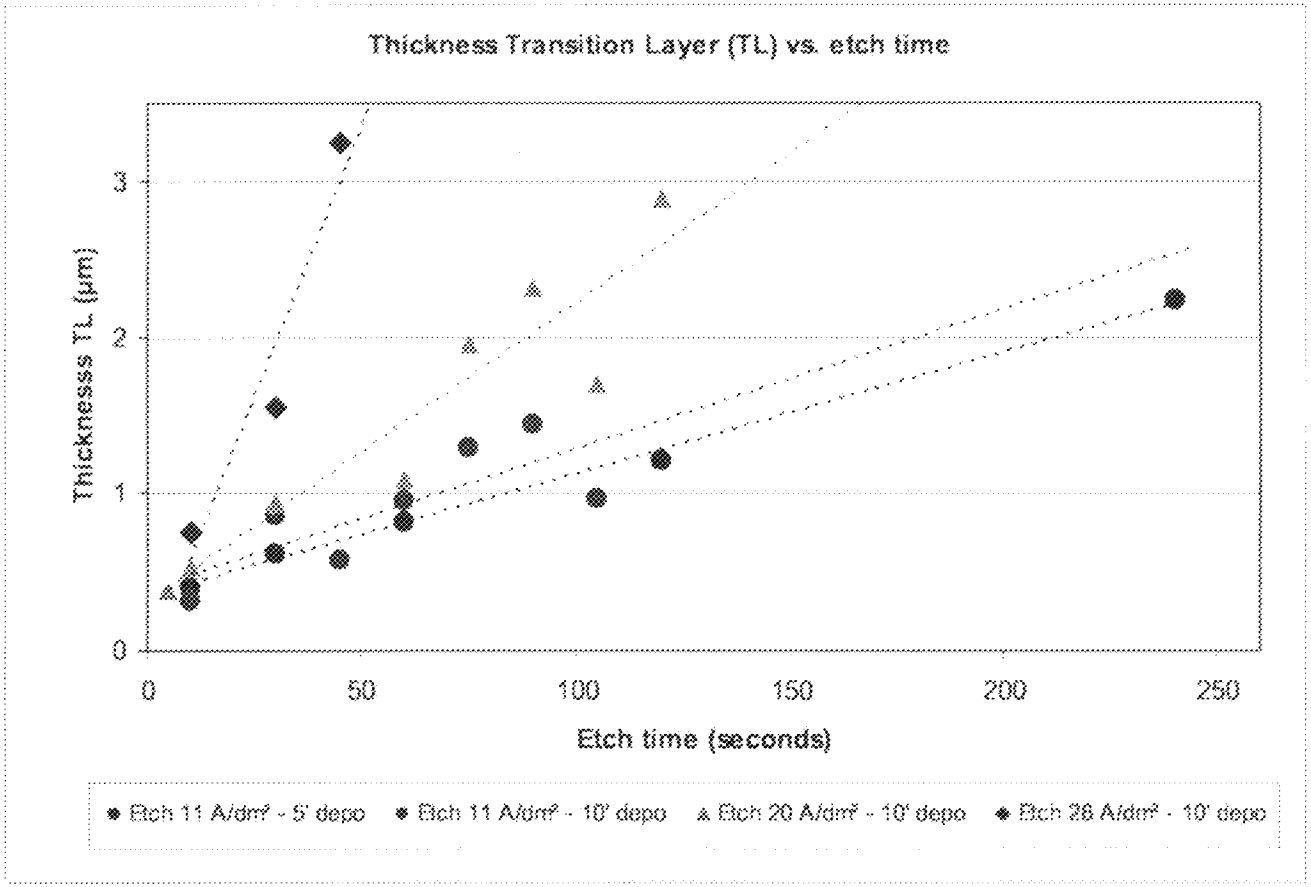
FIG. 3 is a graph representing the thickness of the transition layer as a function of the etch time, for various etch current densities, in the method of the invention applied for depositing a chrome coating.

As can be seen in FIG. 3, the thickness of the transition layer increases as a function of the etch time. Without the pretreatment, the bending test is not passed successfully, in that the coating becomes detached from the substrate at the bend, even at 90° bending angle. The coating is thus not adherent. For etch times between about 5 seconds and about 240 seconds, the coating adheres well to the substrate, however above 60 seconds the quality of the coating begins to deteriorate, with pits forming in the coating surface. The size and/or the amount of the pits increases with the etch time. The pits are not formed during the bending of the sample but are already present on the complete coated surface after the coating process. The adhesion of the coating remains good above 60 seconds etch time in the pretreatment by etching.

Figure 4:
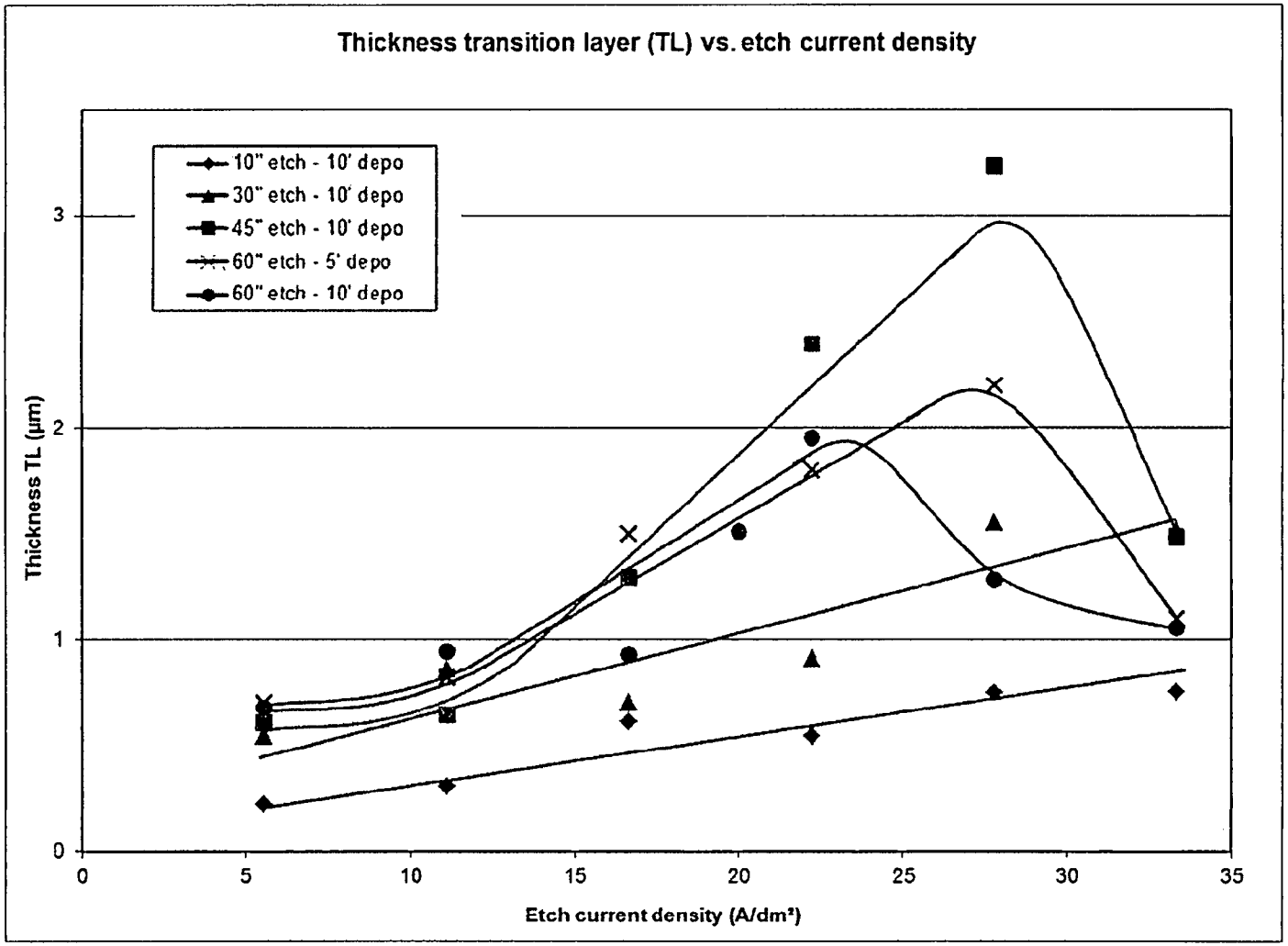
FIG. 4 is a graph representing the thickness of the transition layer as a function of the etch current density for various values of the etch time, in the method of the invention applied for depositing a chrome coating.

A further experiment was conducted, wherein the etch current density was varied in the pretreatment by electrochemical etching, for a number of constant etch times. The results are summarized in FIG. 4.

In this experiment, the thickness of the transition layer reached a maximum at a current density value that is dependent on the etch time and the deposition time: for an etch time of 60 seconds and a deposition time of 10 minutes for the transition layer and coating together, the maximum current density is at about 22 A/dm$^2$, and this maximum shifts to higher current density values for lower etch times and for lower deposition times (as seen from the curve corresponding to 5 minutes deposition time, for transition layer and coating together). Which deposition time for the coating will be chosen when the method according to the invention is used will however in practice depend on the thickness of the coating layer that is desired. The desired coating thickness will depend on the type of part that is to be provided with the coating and the envisaged use of that part. For some parts, a coating thickness of a few micrometers will be sufficient, while for other parts for example a coating thickness of about 30 μm or about 50 μm will be desired. Generally, the longer the deposition time for the coating, the thicker the coating will be.

Figure 5:
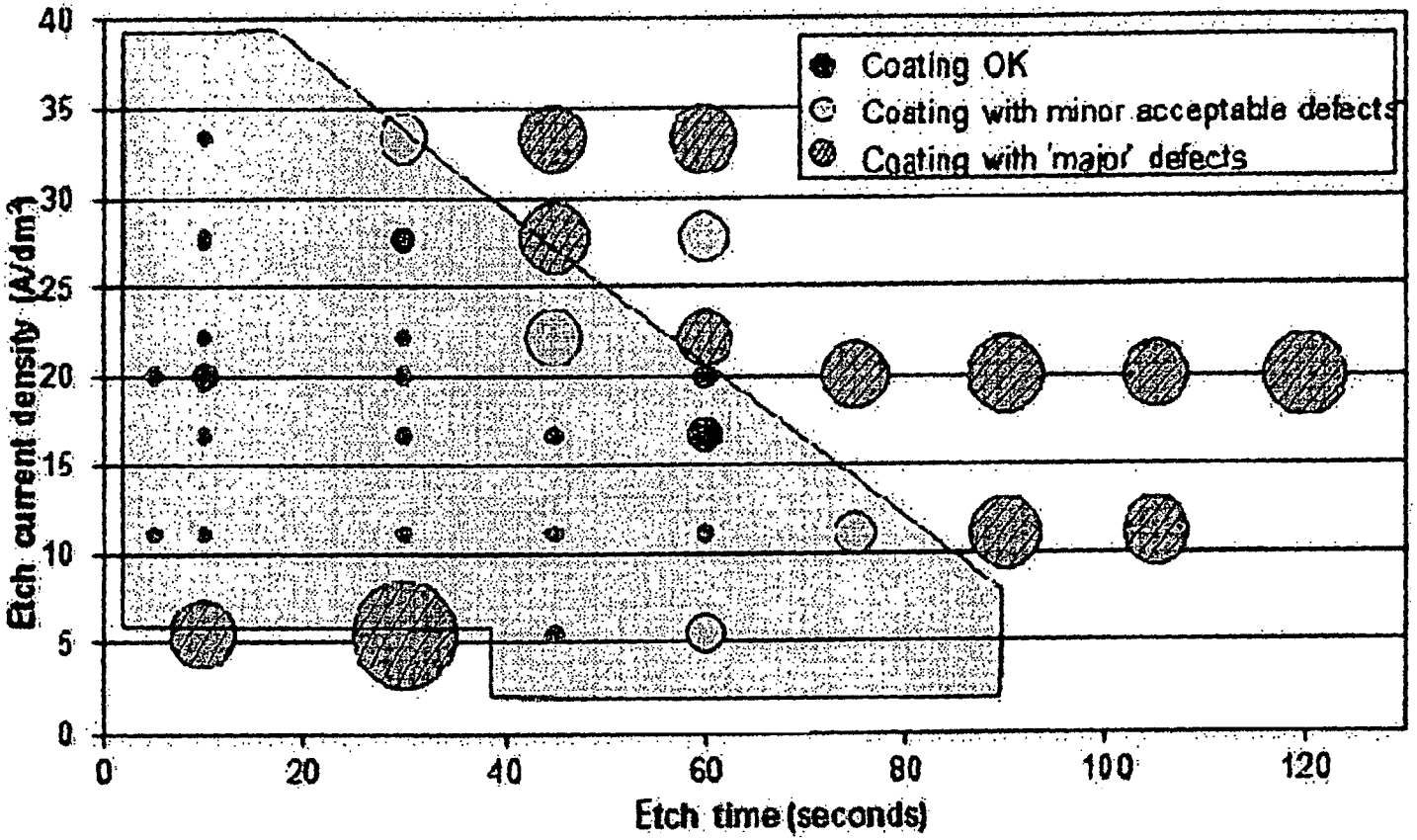
FIG. 5 shows a suitable combination of parameters in terms of the etch time and etch current density, in which good adhesion is combined with good surface quality of a Cr coating obtained by the method of the invention.

FIG. 5 is a graph that summarizes the coating quality data for the Cr-coated samples of the experiments mentioned above, wherein the deposition time was 10 minutes for transition layer and coating together. The quality of the coating was evaluated by visual and microscopic inspection. The number of observed pits was counted and the average size of them was measured. The product of these two factors is depicted as the bubble size in FIG. 5, i.e. the larger the bubble, the worse the quality. The samples where no pits or cracks were observed received also a small value in this graph, since otherwise they would be invisible. These values are marked as the full gray circles (with legend "Coating OK"). In this graph the quality of the bended coating is shown as a function of the applied etch time and etch current density.

It can be seen in FIG. 5 that for these experiments a process window is existing where an acceptable quality is reached. According to this window, the etch time must be lower than about 80 to 90 seconds, with the maximum etch time becoming lower for increasing current densities. If the etch time and the etch current density are too low, the surface may be not pretreated well enough (e.g. not all oxides removed) and/or not enough ions of the first metallic element are released into the ionic liquid, which leads to locations with less adhesion (which can for example be observed as pits or small cracks) and/or the transition layer being too thin. At higher etch times and/or etch current densities (i.e. outside the allowable area), the substrate is locally etched, which leads to formation of pits, while the adhesion still remains acceptable.

Numerically, the allowable area may be described as follows: each etch time has a minimum and maximum current density. For etch times between 5 seconds and 20 seconds, the minimum current density is 7 A/dm$^2$ and the maximum current density is 40 A/dm$^2$. At 40 seconds, the minimum current density is 7 A/dm$^2$ and the maximum current density is 30 A/dm$^2$. At etch times between 20 seconds and 40 seconds, the maximum current density decreases from 40 to 30 A/dm$^2$. At etch times over 40 seconds up to about 90 seconds, the minimum current density becomes about 5 A/dm$^2$. At 45 seconds etch time, the maximum current density is about 27 A/dm$^2$; at 60 seconds etch time the maximum current density is about 22 A/dm$^2$ and at 75 seconds, the maximum current density is about 15 A/dm$^2$. At etch times between 40 seconds and about 80 to 90 seconds, the value for the maximum current density may be estimated by linear interpolation between the abovenamed values.

Several experiments have been conducted to demonstrate the effects of the invention. Two of these experiments and their results will be described below:

Experiment 1

In this experiment, the influence of the etch time during the pretreatment by electrochemical etching has been investigated.

A steel substrate was subjected to the method according to the invention, so the first metallic element was Fe (iron). A chrome coating was deposited on the steel substrate from Cr(III)-ions; so Cr was the second metallic element.

The same ionic liquid was used for pretreatment by electrochemical etching, for depositing the transition layer and for deposition of the coating. The ionic liquid was a mixture comprising choline chloride and CrCl3.6H2O. The substrate was not removed from the bath between pretreatment by electrochemical etching and deposition of the transition layer, and also not between the deposition of the transition layer and deposition of the coating. No rinsing of the substrate took place between any of the method steps according to the invention.

After the deposition of the coating, the substrate was subjected to a 0T-bending test (according to Standard NBN EN 13523-7), in which the substrate was bent up to 180°. The coating and its adherence to the substrate were inspected after this bending.

In this experiment, the following values for the process parameters have been used:

- Etch time: varied between 0 seconds (no etching) to 240 seconds
- Etch current density: 11 A/dm$^2$
- Current density during deposition of the transitional layer and the coating: 20 A/dm$^2$
- Deposition time of transition layer and coating together: 5 minutes.

The following results were obtained:

| Etch time (seconds) | Thickness of transition layer (μm) | Thickness of transition layer + coating (μm) | Results of bending test/ adhesion of coating |
|---|---|---|---|
| 0 | 0 | 5.5 | coating has broken away completely; no coating left after bending |
| 10 | 0.4 | 5.5 | coating OK, adhesion OK |
| 30 | 0.61 | 5.5 | coating OK, adhesion OK |
| 60 | 0.82 | 5.5 | coating OK, adhesion OK |
| 120 | 1.21 | 5.5 | small pits in coating, adhesion OK |
| 240 | 2.24 | 5.5 | larger pits in coating, adhesion OK |

Experiment 2

In this experiment, the influence of the etch time during the pretreatment by electrochemical etching has been investigated.

A steel substrate was subjected to the method according to the invention, so the first metallic element was Fe (iron). A chrome coating was deposited on the steel substrate from Cr(III)-ions, so Cr was the second metallic element.

The same ionic liquid was used for pretreatment by electrochemical etching, for depositing the transition layer and for deposition of the coating. The ionic liquid was a mixture comprising choline chloride and CrCl3.6H2O. The substrate was not removed from the bath between pretreatment by electrochemical etching and deposition of the transition layer, and also not between the deposition of the transition layer and deposition of the coating. No rinsing of the substrate took place between any of the method steps according to the invention.

After the deposition of the coating, the substrate was subjected to a 0T-bending test (according to Standard NBN EN 13523-7), in which the substrate was bent up to 180°. The coating and its adherence to the substrate were inspected after this bending.

In this experiment, the following values for the process parameters have been used:

Etch time: 60 seconds

Etch current density: varied between 0 A/dm$^2$ (no etching) and 33 A/dm$^2$

Current density during deposition of the transitional layer and the coating: 20 A/dm$^2$ Deposition time of transition layer and coating together: 5 minutes.

The following results were obtained:

| Etch current density (A/dm$^2$) | Thickness of transition layer (μm) | Thickness of transition layer + coating (μm) | Results of bending test/ adhesion of coating |
|---|---|---|---|
| 0 | 0 | 5.5 | coating has broken away completely; no coating left after bending |
| 6 | 0.7 | 6.7 | coating OK, adhesion OK |
| 11 | 0.82 | 5.5 | coating OK, adhesion OK |
| 17 | 1.5 | 6.5 | coating OK, adhesion OK |
| 22 | 1.8 | 6.1 | coating OK, adhesion OK |
| 28 | 2.2 | 7.64 | small pits in coating, adhesion OK |
| 33 | 1.1 | 6.8 | larger pits in coating, adhesion OK |

The invention further pertains to a method and metal substrate as defined by the following clauses:

Clauses:

1. A method for electrochemical deposition of a metal coating on a metal substrate (3), using an ionic liquid (2) as the electrolyte, comprising the steps of:
   Pre-treating the substrate surface by subjecting the substrate to etching in a bath (1) of a suitable etching liquid,
   Depositing said coating by electrochemical deposition in a bath of said ionic liquid,
2. The method according to clause 1, wherein said etching step is an electrochemical etching step and wherein said etching liquid is an ionic liquid.
3. The method according to clause 2, wherein the etching liquid is an ionic liquid of the same type as the ionic liquid used in the deposition step.
4. The method according to clause 3, wherein said etching and said deposition steps are performed in the same bath of said ionic liquid and wherein the substrate is not removed from said bath between the etching step and the deposition step.
5. The method according to clause 2 or 3, wherein the etching step is performed in another bath of ionic liquid than the deposition step.
6. The method according to any one of clauses 2 to 5, wherein the etch current density applied during said pretreatment step is between 5 A/dm$^2$ and 150 A/dm$^2$ and the etch time is between 5 s and 500 s.
7. The method according to clause 6, wherein the etch current density is between 5 A/dm$^2$ and 100 A/dm$^2$ and/or the etch time is between 5 s and 400 s.
8. The method according to clause 6, wherein the etch current density is between 5 A/dm$^2$ and 50 A/dm$^2$ and/or the etch time is between 5 s and 250 s.
9. The method according to clause 8, wherein the etch current density is between 5 A/dm$^2$ and 35 A/dm$^2$.
10. The method according to any one of clauses 6 to 9, wherein at least in a portion of the range for the etch time, the etch current density is between 5 A/dm$^2$ and a value that is linearly decreasing as a function of increasing etch times.
11. The method according to any one of the preceding clauses, wherein the substrate is not rinsed in between the etching step and the deposition step.
12. The method according to any one of clauses 1 to 11, wherein said metal coating is a chrome coating or a chrome alloy coating.
13. The method according to clause 12, wherein the same ionic liquid is used for etching and for deposition, said ionic liquid being a mixture consisting of or comprising choline chloride and CrCl3.6H2O.
14. The method according to any one of the preceding clauses, wherein said substrate is a steel substrate.
15. A metal substrate provided with a metal coating, produced by the method according to any one of the preceding clauses, the substrate comprising a first metallic element being the main component of said substrate, and the coating comprising a second metallic element being the main component of the coating, wherein a transition layer is present between the substrate and the coating, said transition layer having a thickness, and wherein the concentration of the first metallic element changes from a high value to a low value according to a gradually decreasing profile from the substrate towards the coating, and wherein the concentration of the second metallic element changes from a high value to a low value according to a gradually decreasing profile from the coating towards the substrate.

The invention claimed is:

1. A method for electrochemical deposition of a metal coating on a metal substrate, wherein the metal substrate comprises a first metallic element as a main component, the method comprising:

pretreating a surface of the metal substrate by subjecting the substrate to etching in an ionic liquid, wherein the ionic liquid contains metal ions of a second metallic element, during said etching removing metal ions of the first metallic element from the metal substrate, wherein the metal ions of the first metallic element are received by the ionic liquid;

depositing a transition layer on the metal substrate by electrochemical deposition from said ionic liquid, wherein the ionic liquid contains the metal ions of the first metallic element that were removed from the metal substrate during the etching and metal ions of the second metallic element, both the metal ions from the first metallic element and the metal ions of the second metallic element being incorporated in the transition layer that is deposited on the metal substrate; and depositing a coating on the transition layer by electrochemical deposition from an ionic liquid containing ions of the second metallic element, wherein a flow of the respective ionic liquid is provided over the surface of the metal substrate during the deposition of the transition layer and during the deposition of the coating, wherein a velocity of the flow of the ionic liquid relative to the surface of the metal substrate is less than 1 m/sec.

2. The method according to claim 1, wherein the step of pretreating the surface of the metal substrate is carried out by electrochemical etching.

3. The method according to claim 2, wherein a process parameter of the pretreatment by electrochemical etching is an etch current density, wherein the etch current density is between 5 A/dm$^2$ and 22 A/dm$^2$, and wherein another process parameter of the pretreatment is an etch time, wherein the etch time is between 20 seconds and 80 seconds.

4. The method according to claim 2, wherein an etch current density of the pretreatment by electrochemical etching is between 5 A/dm$^2$ and 40 A/dm$^2$.

5. The method according to claim 2, wherein at least in a portion of the pretreatment by electrochemical etching, an etch current density is between 5 A/dm$^2$ and a value that is decreasing as a function of increasing etch times.

6. The method according to claim 2, wherein an etch current density has a value within a range between a minimum current density and a maximum current density, and wherein, for etch times over 40 seconds and up to about 90 seconds, the minimum current density is about 5 A/dm$^2$, wherein, for etch times between about 5 seconds and up to 40 seconds, the minimum current density is about 7 A/dm$^2$, wherein for etch times between about 5 seconds and about 20 seconds, the maximum current density is about 40 A/dm$^2$, wherein for an etch time of about 40 seconds, the maximum current density is about 30 A/dm$^2$, wherein for an etch time of about 45 seconds, the maximum current density is about 27 A/dm$^2$, wherein for an etch time of about 60 seconds, the maximum current density is about 22 A/dm$^2$, and wherein for an etch time of about 75 seconds, the maximum current density is about 15 A/dm$^2$.

7. The method according to claim 1, wherein the ionic liquid that is used for pretreatment and for depositing the transition layer is present in a bath, and wherein the pretreatment step and the step of deposition of the transition layer are performed in said bath of ionic liquid.

8. The method according to claim 7, wherein the metal substrate remains in said bath between the pretreatment and the step of depositing the transition layer.

9. The method according to claim 7, wherein the step of depositing the coating takes place in a different bath of ionic liquid from the bath in which the pretreatment and depositing the transition layer have been carried out.

10. The method according to claim 7, wherein the step of depositing the coating takes place in the ionic liquid in which the pretreatment and depositing the transition layer have been carried out.

11. The method according to claim 1, wherein the metal substrate is not rinsed in between the pretreatment step and the step of depositing the transition layer.

12. The method according to claim 1, wherein said second metallic element is chrome (Cr), and is present in the ionic liquid used for the pretreating in the form of chrome(III) (Cr(III)).

13. The method according to claim 12, wherein the ionic liquid used for the pretreating is a mixture consisting of or comprising choline chloride and $CrCl_3.6H_2O$.

14. The method according to claim 1, wherein said metal substrate is a steel substrate and the first metallic element is iron (Fe).

15. The method according to claim 1, wherein the deposited transition layer has a thickness between about 0.15 μm and about 5 μm.

16. The method according to claim 1, wherein a process parameter of the pretreatment is an etch time, wherein the etch time is between 5 seconds and 240 seconds.

* * * * *